United States Patent [19]

Weiss et al.

[11] Patent Number: 4,972,488

[45] Date of Patent: Nov. 20, 1990

[54] EAR WAX BARRIER AND ACOUSTIC ATTENUATOR FOR A HEARING AID

[75] Inventors: Erwin M. Weiss, Northbrook; Mark F. Stanton, Mundelein, both of Ill.

[73] Assignee: Beltone Electronics Corporation, Chicago, Ill.

[21] Appl. No.: 365,083

[22] Filed: Jun. 12, 1989

Related U.S. Application Data

[63] Continuation-in-part of Ser. No. 170,023, Mar. 31, 1988, Pat. No. 4,870,689, which is a continuation-in-part of Ser. No. 37,330, Apr. 13, 1987, abandoned.

[51] Int. Cl.[5] ..... H04R 25/02

[52] U.S. Cl. ..... 381/68.6; 381/68; 381/69

[58] Field of Search ..... 381/68.6, 68, 69, 68.1; 181/135; 128/864, 867, 857

[56] References Cited

U.S. PATENT DOCUMENTS

| | | | |
|---|---|---|---|
| 3,097,643 | 7/1963 | Santi | 128/152 |
| 3,197,577 | 7/1965 | Kuklock | 381/68.6 |
| 3,374,318 | 3/1968 | Martin | 381/68.6 |
| 3,408,461 | 10/1968 | Langford | 381/68.6 |
| 3,876,843 | 4/1975 | Moen | 381/69 |
| 4,870,689 | 9/1989 | Weiss | 381/69 |

FOREIGN PATENT DOCUMENTS

| | | |
|---|---|---|
| 1951165 | 12/1966 | Fed. Rep. of Germany . |
| 2475389 | 8/1981 | France . |
| 528198 | 10/1972 | Switzerland . |
| 2070890 | 12/1972 | United Kingdom . |
| 1385518 | 9/1981 | United Kingdom . |

*Primary Examiner*—Jin F. Ng
*Assistant Examiner*—M. Nelson McGear, III
*Attorney, Agent, or Firm*—Allegretti & Witcoff, Ltd.

[57] ABSTRACT

A barrier for a hearing aid that combines the feature of both (1) preventing ear wax from contacting and damaging the internal components of a hearing aid or hearing aid receiver and (2) variably dampening the acoustic response of the hearing aid. The barrier includes, in combination, a housing defining a central axis of passage, as well as a plurality of projections and a screen. The projections extend inwardly from the interior surface of the housing, each projection partially occluding the cross-sectional area of the housing. The projections provide a tortuous path for ear wax migrating into the hearing aid, and the screen provides additional area for wax accumulation. The projections and screen also dampen or otherwise modify the frequency response of the hearing aid. The screen may also be interchanged or adjusted to accommodate the specific frequency attenuation needs of a particular user.

5 Claims, 9 Drawing Sheets

Fig. 20
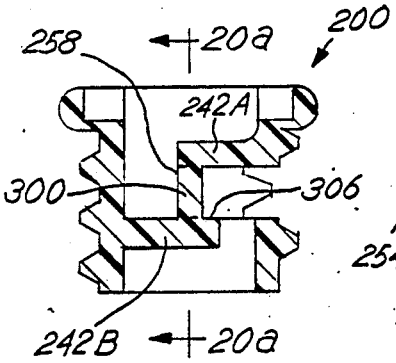
Fig. 20a
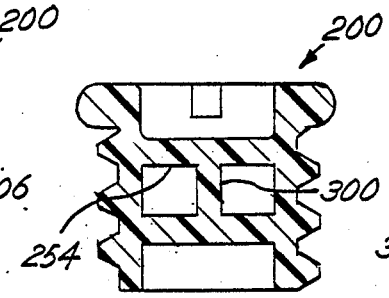
Fig. 21
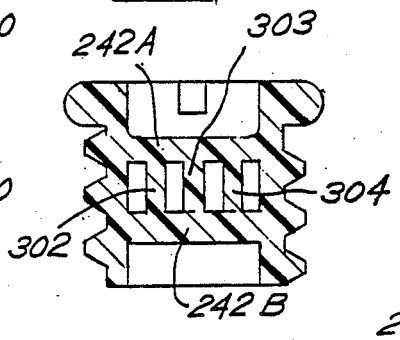
Fig. 23
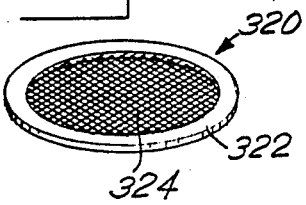
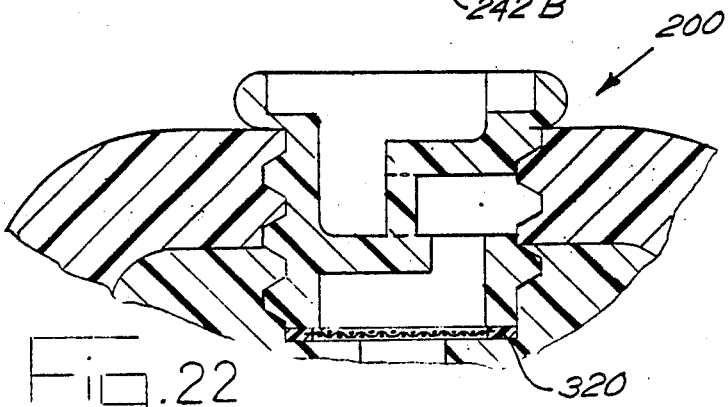
Fig. 22
Fig. 24
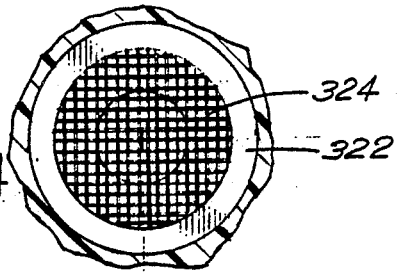
Fig 25
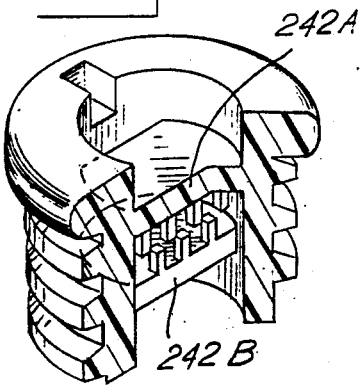
Fig. 26
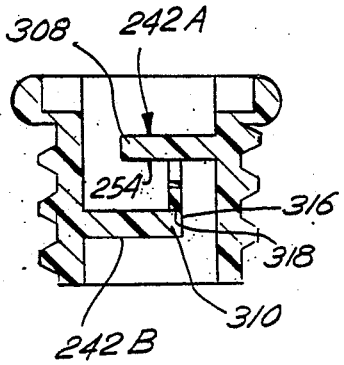
Fig. 27
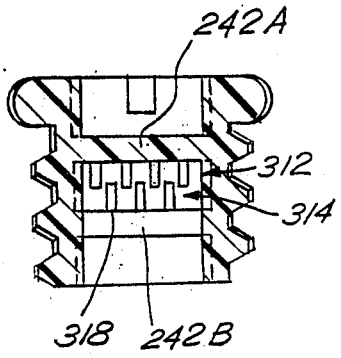

EAR WAX BARRIER AND ACOUSTIC ATTENUATOR FOR A HEARING AID

CROSS REFERENCE TO RELATED APPLICATIONS

This application is a continuation-in-part application of prior co-pending application Ser. No. 170,023 filed Mar. 31, 1988, now U.S. Pat. No. 4,870,689 the contents of which are incorporated herein by reference. Application Ser. No. 170,023 was a continuation-in-part of prior application Ser. No. 037,330 filed on Apr. 13, 1987 now abandoned.

BACKGROUND OF THE INVENTION

1. Introduction

The present invention relates generally to ear wax barriers and acoustic attenuators. More particularly, the invention relates to a barrier that reduces the amount of ear wax that may enter the sound channel of a hearing aid device, such as "in-the-ear" or "canal" type hearing aids or acoustical resonators, and that may furthermore effectively modify the frequency response of the hearing aid device.

Most hearing aids include a housing, or shell, that holds the components of the aid. The shell of many aids are designed to rest within the ear canal of a user. The shell of an electronic hearing aid may hold, for example, a microphone, amplification circuitry, and a receiver. The microphone is exposed to sound signals from outside of the aid and responsively creates an electrical signal. The electrical signal may be sent to the amplifying circuitry or other electrical aid components. Such components, in turn, supply a signal to the receiver, and the receiver responsively creates sound.

In many electronic hearing aids, the sound travels from an output port of the receiver, through a sound channel in the aid, and out of the aid through an output port in the shell of the aid. The sound from the shell output port may then travel through the user's ear canal and cause the ear drum to vibrate.

The ears of most hearing aid users naturally secrete a substance referred to as cerumen or ear wax. While the ear wax cleans the internal structure of an ear, it also tends to flow into the sound channel and receiver of the hearing aid. Upon entering the receiver, the ear wax interferes with, or prevents, the proper operation of the receiver.

Small, cosmetic "in-the-ear" aids and "canal" aids (which typically lay at least partially within the user's ear canal) have now been developed. With such aids, however, the physical volume inside of the hearing aid available for components is reduced. This is particularly true, for example, when the interior of the user's ear is relatively small.

Furthermore, the technology associated with hearing aid manufacture frequently involves fabricating the shell out of plastic. The shell is contoured to the shape of the inner surface of the ear. The thickness of the shell is dictated by the requirement that the shell physically maintain its structural integrity and protect the aid components inside. The wall thickness of the shell, however, reduces the physical volume inside the hearing aid available for components. The reduced volume increases the need for a means for attenuating sound signals with smaller components.

The resulting limited space within the hearing aid available for components generally requires that the receiver be positioned as deep as possible in the user's canal. However, such positioning of the hearing aid within the canal brings the receiver output port into closer proximity to the ear canal environment containing the wax-generating tissue inside the ear canal.

Thus, while the introduction of in-the-ear and canal aids has improved the acceptance of hearing aids by the hearing-impaired public, such hearing aids have created problems associated with smaller components and greater ear wax build up within the hearing aid. Each of these two problems is discussed below.

2. Wax Migration--Prior Art

As those of the ordinary skill in the art will acknowledge, ear wax migration has been recognized as a difficult problem. The migration of wax into the sound channel and receiver of hearing aids substantially increases the susceptibility of many receivers to clogging. The progressive, gradual clogging of the receiver results in the reduction of acoustic gain and in power output by the receiver, sometimes culminating in the complete failure of the aid to provide amplified sound.

The degradation or failure of performance of the aid is annoying to the user. When wax blockage occurs, the hearing aid may require complete disassembly so that the receiver may be cleaned or replaced. Of course, bringing the hearing aid to a service center for disassembly and possible replacement of the receiver is both inconvenient and expensive for the user.

A number of presently available systems are poorly suited to guard against ear wax buildup in the receiver of a hearing aid. Some "barrier" designs use a fine mesh screen in the sound channel between the receiver and the outside of the hearing aid. Such screens suffer from the deficiency, however, that if the screen size is made sufficiently small to protect the receiver from wax migration, the screen holes will eventually be clogged by the wax. When mesh is made more coarse, however, wax will not be as effectively prevented from migrating across the screen barrier to the receiver.

Other systems for preventing wax migration into a receiver include providing a single aperture, of a small cross sectional area, between the receiver and the outside of the aid. Other systems involve the replacement of a cellular synthetic material between the receiver and outside of the aid. Such designs often suffer from the same deficiency of not simultaneously achieving both a long-term barrier to wax migration and still preventing the clogging of wax over the life of the aid.

Such porous barriers, thus, generally result in an unsatisfactory trade-off between resistance to wax clogging of the barrier itself, on the one hand, and the prevention of wax migration into the receiver on the other. While a small aperture barrier may prevent wax migration, it will also clog. Large apertures may not clog, but they also will not be as effective in blocking wax.

Small pore barriers placed in the pathway between the receiver and the output port of the hearing aid may cause increased acoustic impedance Increased impedance may result in an undesired change in the frequency response in output pressure levels delivered by the receiver. While it may often be desirable to modify the frequency response of a hearing aid in order to better meet the needs of a particular hearing aid user, such modification should not occur haphazardly because of wax buildup. Planned modification of the frequency response, however, often involves disassembling the aid and altering the internal structure of the aid.

3. Acoustic Attenuation--Prior Art

As is also recognized by those of ordinary skill in the art, it is often advantageous and desirable to smooth out the peaks in the receiver response characteristics, and otherwise attenuate the acoustic response of an aid. See, for example, the damped and undamped receiver output characteristics shown in FIG. 1. Such attenuation may improve the sound quality of the aid and thus improve the usefulness of the aid to the hearing impaired.

Some prior art devices, for example, use a barrier inserted in a hearing aid sound passageway distal from the receiver output port. The barrier may consist of a porous element, providing a fixed acoustic response. Such a barrier may smooth out the peaks of the frequency response of a hearing aid receiver in a substantially fixed, non-varying manner. However, many such elements are not easily removed and replaced in the field, nor are the damping characteristics of the barrier easily altered.

As is recognized in the art, variable damping is often desirable to accommodate the requirement of persons with different hearing requirements and impairments. Also, it is often desirable for a trained hearing aid dispenser (and not the hearing aid user) to adjust the damping characteristics of such a barrier and to clear the aid of excess wax built up within the aid.

The ability to adjust the hearing aid frequency response in the field is particularly important, since different wearers require different frequency response characteristics, and such characteristics most frequently cannot be determined in advance. The characteristics can frequently only be determined based on the actual experience of the wearer. The aid dispenser must be able to adjust the frequency response of the aid in the field for proper operation of the aid.

Thus, it is desirable for a single unit to provide the twofold function of providing variable acoustic damping and blocking potentially harmful ear wax. Moreover, such a device, which combines both features, should simultaneously allow easy adjustment and removal by a hearing aid dispenser.

SUMMARY OF THE INVENTION

A principal aspect of the present invention is a barrier for a hearing aid. For illustrative purposes, the invention is particularly described herein as used with an electronic hearing aid. However, those skilled in the art will understand that the invention also is useful with acoustical resonators, acoustical hearing aids, and in other ear-related apparatus which would benefit from a similar barrier.

The hearing aid includes a shell and a receiver within the shell. Both the shell and receiver include an acoustic output port. The barrier includes a housing with a plurality of projections. The housing interconnects the acoustic output ports of the receiver and shell. The housing defines an interior surface and a central axis of passage between said two ends of the housing.

The projections may be displaced from each other. Both extend inwardly from the interior surface of the housing. Each projection partially occludes a portion of the housing interior. Consequently, the projections provide a tortuous path for solid or semiliquid ear wax migrating axially along the inside of the housing.

Moreover, the barrier may further include a variable acoustic attenuator. The variable attenuator and projections cooperatively define means to dampen or otherwise modify the frequency response of the hearing aid.

Thus, an object of the present invention is an improved ear wax barrier for a hearing aid. Another object is an improved acoustic attenuator for a hearing aid. Still another object is an improved acoustic attenuator in combination with an improved ear wax barrier.

Another object of the present invention is a barrier that more effectively resists wax clogging. Still another object is a barrier that more substantially blocks the migration of naturally occurring ear wax, thereby reducing the clogging of a hearing aid receiver. Still a further object is a barrier that presents less acoustic impedance to a receiver when placed between the receiver and the acoustic exit port of the hearing aid.

Another object is a barrier that collects wax and need not be cleaned nor changed as frequently over the life of the hearing aid. Another object is a wax barrier that is inexpensive to make and maintain, thereby lowering the cost of hearing aids for consumers.

Still a further object is a barrier that more predictably modifies the frequency response of the hearing aid. Another object is a barrier that more easily allows adjustment of the acoustic damping of the hearing aid receiver output in the field. Still another object is a barrier that is more easily removed in the field for replacement or adjustment. Thus, of course, it is an overall object of the present invention to provide an apparatus which combines both a more effective ear wax barrier and a variable acoustic attenuator that is easier to adjust and remove in the field.

BRIEF DESCRIPTION OF THE DRAWING

A preferred embodiment of the present invention is described herein with reference to the drawing wherein:

FIG. 20 is a cross-sectional view of the barrier shown in FIG. 11 illustrating a modified projection for the barrier;

FIG. 20*a* is a cross-sectional view of FIG. 20 taken along the line 20*a*—20*a*;

FIG. 21 is a cross-sectional view of a second, alternative embodiment of the projection for the barrier shown in FIG. 20;

FIG. 22 is a partial cross-sectional view of the barrier shown in FIG. 11 with the screen of FIG. 23 inserted to modify the ear wax barrier;

FIG. 23 is a perspective view of a screen used in a further modification of the barrier;

FIG. 24 is a top plan view of the screen shown in FIG. 23;

FIG. 25 is a perspective cross-sectional view of a still further modification of the barrier of the present invention;

FIG. 26 is a cross-sectional view of the modification of the barrier shown in FIG. 25;

FIG. 27 is a cross-sectional view of FIG. 26 taken along the line 27—27;

DETAILED DESCRIPTION OF THE PREFERRED EMBODIMENTS

Referring to FIGS. 1–42, a preferred embodiment of the present invention is shown as an improved barrier, generally designated 20, for an "in the ear" or "canal" type hearing aid, illustratively designated 22.

So-called "custom" or generic hearing aids are designed to fit either in the bowl of the ear or, alternatively, in the ear canal itself. Prior to the development of such aids, however, hearing aids were designed to be worn behind the ear or elsewhere.

Figure 1:
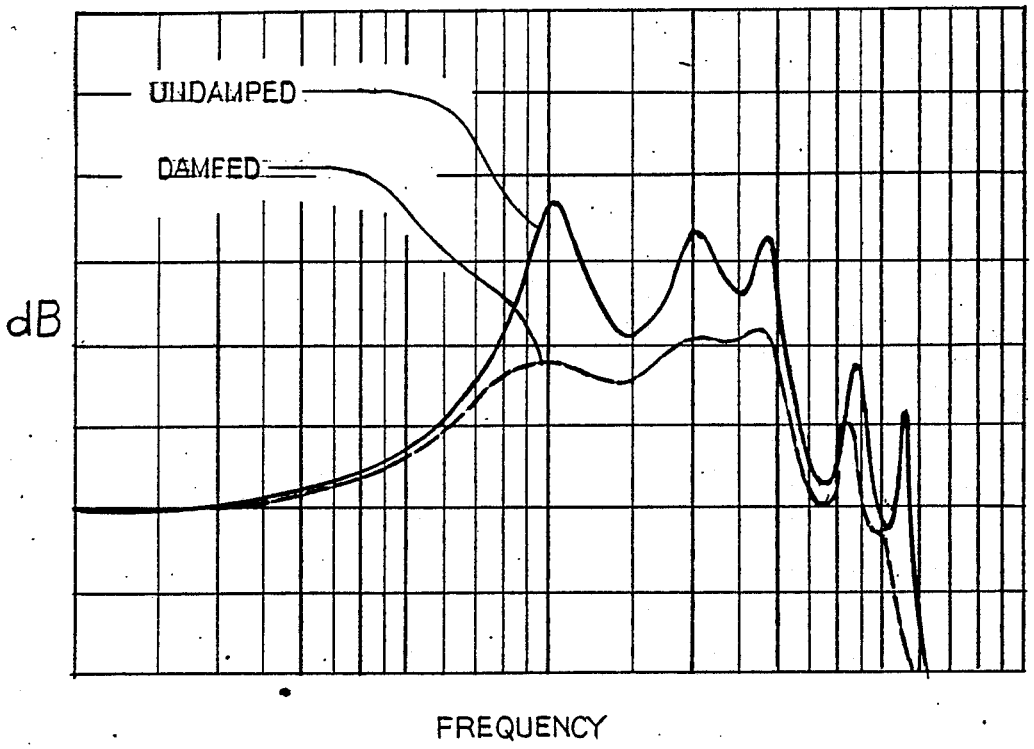
FIG. 1 is a graphical representation, for illustrative purposes only, of both damped and undamped frequency response characteristics of a hearing aid receiver.
Figure 2:
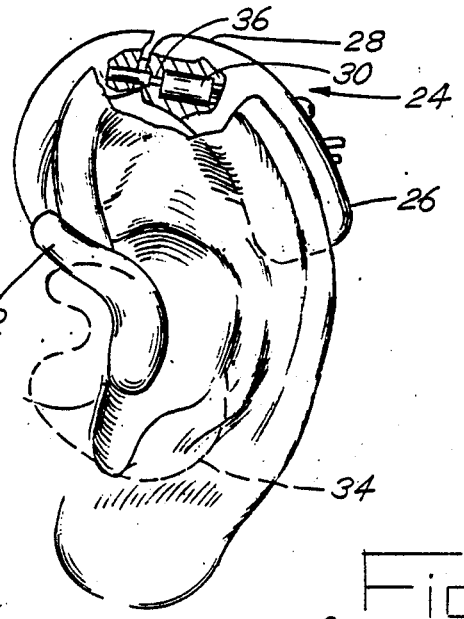
Fig. 2 (PRIOR ART)
FIG. 2 is a front, partially cut away view of a prior art behind-the-ear hearing aid, in use on a user's ear.

A prior art behind-the-ear hearing aid is shown in FIG. 2 and designated 24. The hearing aid, or "aid," 24 included a plastic case 26 to house the hearing aid components. Typical components included a microphone 28, amplifying circuitry (not shown), receiver 30, plastic tubing 32, and ear mold 34.

The microphone would receive a sound signal from outside the ear and convert it to an electrical signal. An electrical signal was then responsively transmitted to the receiver 30.

The receiver 30 included an acoustic output port 36 interconnected to the tubing 32. Upon receiving signals from the electrical components within the aid 24, the receiver 30 would transmit sound signals through its exit port 36. These sound signals were then conducted, via the tubing, to the ear mold 34 and the interior of the ear of the user.

In the prior art embodiment shown in FIG. 2, the acoustic exit port 36 of the receiver 30 was physically isolated from the ear environment by the tubing 32. As a result, the migration of the solid or semiliquid ear wax material into the receiver 30 was negligible due to the physical length of the tubing.

With the decreased size of electronic components in the 1970's and 1980's, however, more cosmetically attractive hearing aids could be constructed. Such aids fit in the ear or the ear canal of the user. See the aid 22, shown in FIG. 3.

Figure 3A:
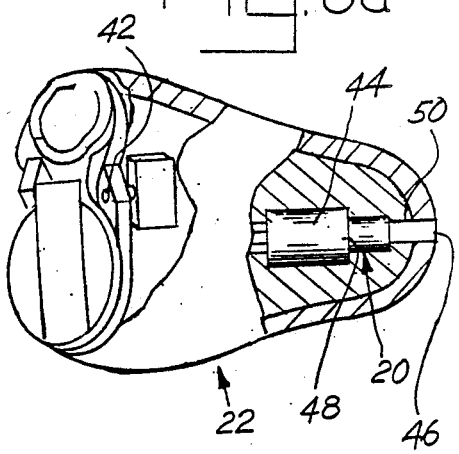
FIG. 3*a* is a perspective, partially cut away view of the preferred embodiment shown in FIG. 3.
Figure 3:
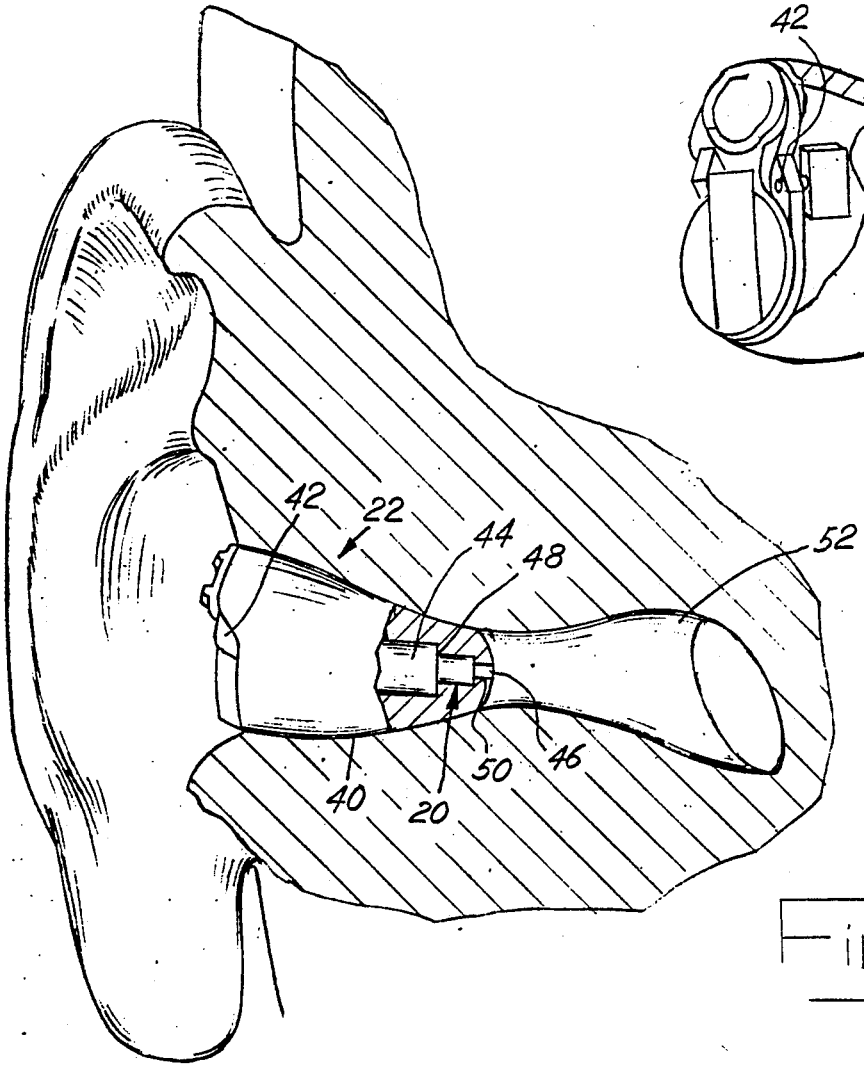
FIG. 3 is a right side, partially cut away view of a preferred embodiment of the present invention, showing an in-the-ear hearing aid with a barrier in use within a user's ear.

Like the prior art aid 24 shown in FIG. 2, the aid 22 shown in FIGS. 3 and 3*a* also includes a shell 40 which may also include a microphone 42, amplification circuitry (not shown) and a receiver 44. The shell 40 and receiver 44 each include an acoustic output port, respectively designated 46, 48.

The output ports 46, 48 of the shell 40 and receiver 44 are interconnected by a hearing aid sound channel 50. The barrier 20 is positioned in the channel 50 between the two acoustic output ports 46, 48. Thus, sound exists from output port 48 of the receiver 44, travels through the barrier 20, through the sound channel 50, and out the output port 46 of the shell 40.

Again, the microphone 42 receives sound signals and responsively transmits an electrical signal. An electrical signal, in turn, is sent to the receiver 44, which converts it to a sound signal. The sound signal is then transmitted, through the acoustic port 48 of the receiver 44, through the sound channel 50 of the aid 22, to the acoustic exit port 46 in the shell 40 of the hearing aid 22. After leaving the shell 40 of the aid 22, the sound may travel down the ear canal 52 of the user, to the ear drum.

As shown in FIGS. 3 and 3*a*, the receiver exit port 48 is in close proximity to the ear canal 52 containing wax generating tissue. As a result, wax frequently migrates through the exit port 46 in the shell 40, upward through the sound channel 50, and into the exit port 48 and the receiver 44 itself. This causes clogging of the receiver 44 or shell port 46, reducing its acoustic gain, power output, and occasionally the complete failure of the aid 22 to amplify or otherwise modify sound.

In a preferred embodiment of the present invention, the barrier 20 is interconnected between the receiver 44 and acoustic exit port 46 of the hearing aid shell 40, as shown in FIGS. 3 and 3*a*. For the preferred embodiment shown, the acoustic output port 48 of the receiver 44 is approximately cylindrical. Thus, the barrier 20 itself is substantially cylindrical, fitting snugly in the shell output port 46. See FIGS. 3 and 3*a*. As shown in FIGS. 3 and 3*a* (for example, in FIG. 13) the barrier 20 may be placed in a variety of locations between the receiver 44 and acoustic output port 46.

In other embodiments, of course, the barrier 20 may be comprised of other cross sectional configurations. Thus, for example, the barrier 20 could be made a part of the hearing aid 24. That is, the barrier 20 may be assembled as a part of the shell 40 or as a part of the receiver 44.

The barrier 20 further acts as a variable acoustic resistance to acoustically dampen the frequency response of the hearing aid receiver. See the example of acoustic damping shown, for illustrative purposes only, in FIG. 1.

Figure 4:
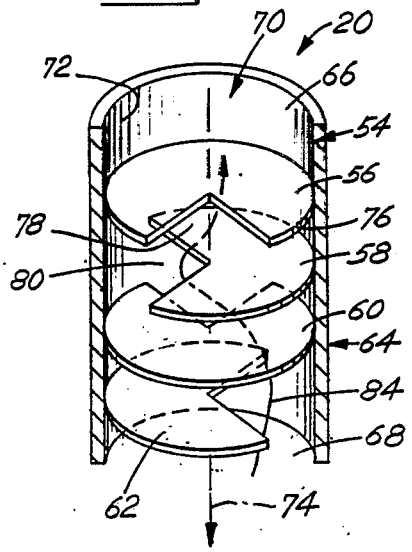
FIG. 4 is a perspective, partial cross-sectional view of the barrier shown in FIG. 3.

As shown in FIG. 4, one embodiment of the barrier 20 includes a housing 54 and first, second, third and fourth projections, respectively designated 56, 58, 60, 62. Of course, a lesser or greater number of projections may be used.

The housing 54 in this embodiment is substantially cylindrical, defining a wall 64 with first and second ends 66, 68 and may be comprised of a variety of materials. In the preferred embodiment, injection molded thermoplastic is used. Examples of materials that might be used to make the housing include "Cycolac," and ABS (Acrylonitrile-Butadiene-Styrene) resin.

The dimensions of the one particular embodiment of the invention herein described follow. Of course, alternative embodiments are possible, and the dimensions should not be read to limit the scope of the present invention.

The housing 54 defines a length, between the first and second ends 66, 68, of approximately 0.35 inch, and the inside diameter of the housing 54 is approximately 0.11 inch. The thickness of the housing wall is approximately 0.01 inch, and the housing 54 further defines an interior chamber 70 and an interior surface 72. In addition, the housing 54 defines a central axis of passage 74 between the first and second ends.

In the one preferred embodiment herein described, the central axis 74 passes through the center of a roughly cylindrical housing 54, substantially equidistant at all points from the interior surface 72 of the housing 54. The first end 66 fits snugly into the receiver exit port 48. The second end 68, distal from the receiver 44 when in use in a hearing aid 22, faces the acoustic exit port 46 of the hearing aid shell 40 and the interior of the user's ear.

As shown, each of the four projections 56–62 is substantially similar to the others. (Of course, a single barrier could also use a variety of differently shaped projections.) Only the first projection 56 is discussed in detail below for illustrative purposes.

The projection 56 is attached to the interior surface 72 of the housing 54 and extends inwardly toward the central axis 74 of the housing 54. The projection 56 partially occludes the central acoustical passageway or interior housing chamber 70.

In the preferred embodiment, the projection 56 is comprised of a thermoplastic that can be injection molded, just as the housing 54 is. In an alternative embodiment, of course, the projection 56 could also be covered with a coating that exhibits a low cohesion to cerumen. Such coatings include, for example, "Teflon". Such a coating would make any projection or housing easier to clean after wax has built up upon it.

If the housing 54 is cylindrical, the projection 56 defines an outside perimeter 76, a portion of which resembles a circle. Alternatively, the projection 56 may be described as a disk. While the invention encompasses a variety of projection shapes, the preferred embodiment of FIG. 4 includes a disk having a wedge-shaped gap 78. In this one preferred embodiment, the projection 56 defines a maximum outside diameter of approximately 0.11 inch, so that it fits tightly against the interior surface 72 of the housing 54.

In the preferred embodiment, the projection 56 is attached to the interior surface 72 of the housing 54. In the preferred embodiment, the attachment is accomplished with strong glue such as a cyanoacrylate ester. In alternative embodiments, however, the projection 56 could be molded as part of the housing 54, or alternatively, simply press fit into the interior chamber 70 of the housing 54, or otherwise attached to the housing 54.

The housing 54 in the preferred embodiment defines an interior cross-sectional area of a circle and circle interior. Again, a portion of the circle interior is occluded by the projection 56. In the preferred embodiment shown in FIG. 4, the projection 56 is in the shape of a disk with a wedge 78 removed. The "removed" portion is described as a "wedge" 78 for purposes of illustration. It is to be understood, of course, that while a wedge typically has only straight sides, the wedge 78 defining an open area in the present context may also include one rounded side missing from the rounded projection 56, shown in FIG. 4.

Using alternative terminology, the projection 56 may be described as a "270° circle portion." The central axis 74 of the housing 54 defines the center point of the circle. Also, the "gap" from the projection 56, may be described as a 90° circle portion.

The open wedge 78 of the projection 56 defines an open area in the cross-sectional area of the housing 54. Thus, if one were looking through the housing from the first end 66 toward the second end 68, parallel to the axis 74, the interior of the housing 54 would define a circle interior. The projection 56 would block the interior 76 of the housing 54 except for the wedge 78. The first projection 56 itself defines a first occluded area and the wedge 78 defines a first open area in the cross-sectional area of the housing 54, normal to the axis 74.

It is through this open area, or wedge 78, in the housing 54 that sound may travel from the receiver 44 to the exterior of the aid 22. If this projection 56 were the only barrier, however, wax, under some circumstances, might flow through the open area. Thus, at least the one additional, second projection 58 is usually provided to prevent further passage of ear wax.

In the preferred embodiment, the second projection 58 is placed approximately 0.02 inch away from the first projection 56. Applicant has found that, in the most preferred embodiments, the projections should be placed apart enough so that the projections will not substantially effect the overall acoustic response and the amount of expected wax buildup will be less than the distance between the projections. Thus, spacing between the projections of 0.005 inch to 0.04 inch may be used for the most preferred performance of the barrier 20.

In the preferred embodiment shown, the projections 56–62 are interdigitated within the housing 54, i.e., the projections are specially and angularly displaced with respect to the central axis 74. The projections could be made of a variety of substances, such as, for example, the thermoplastic or semipermeable material. Of course, the projections may be radially or axially displaced from each other.

The second projection 58 is like the first projection 56 in that it defines a second wedge 80. While the second wedge of the preferred embodiment has the same shape as the first wedge 78, the second wedge 80 may, of course differ in size and shape of any other wedge. The second projection 58 and second wedge 80 also define an occluded area and an open area in the housing, normal to the axis 74. The open area of the second projection 58 is positioned over the first occluded area. Thus, a tortuous path is provided for wax which would otherwise migrate from the first end 66 to the second end 68.

For the preferred embodiment shown in FIG. 4, the wedges 78, 80 measure approximately 90°. The second projection 58 is similar to the first projection 56 in design, but has been rotated clockwise 90° from the position of the first projection 56. Finally, the fourth projection 62 has been rotated 90° in a clockwise direction from the position of the third projection 60.

In the preferred embodiment shown in FIG. 4, the open area of each projection is further blocked, or occluded, by occluding portions of three other projections. The interdigitated projections thus cooperate to completely occlude the acoustical passageway 70 against wax migration. That is, every line of migration through the housing 54 along the interior surface 72 is interrupted by a projection. Applicants have found that such a construction provides a tortuous path for ear wax, substantially reducing the amount of ear wax that may migrate from the sound channel 50 to the receiver 44 while, at the same time, providing substantially little acoustic impedance to the receiver 44.

Figure 5:
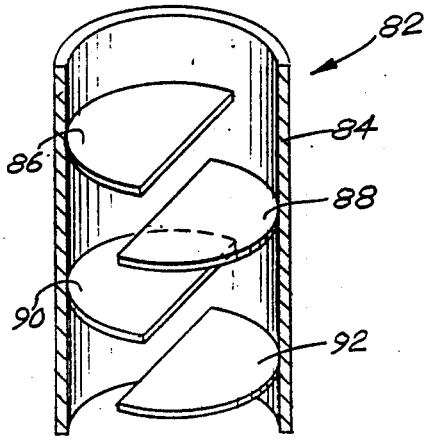
FIG. 5 is a perspective, partial cross-sectional view of a first alternative embodiment of the barrier shown in FIG. 4.

A second embodiment of the preferred invention is disclosed in FIG. 5. The barrier 82 includes a housing 84 and a multiplicity of projections. The barrier 82 includes first, second, third, and fourth projections 86, 88, 90, 92. Construction of the housing 84 is similar to that shown in FIG. 4. Also, the projections 86–92 are of substantially the same thickness and positioned substantially the same distance apart as the embodiment shown in FIG. 4. However, rather than being 270° circle portions, each projection is substantially a 180° circle portion (or semicircle).

The first projection 86 again defines a first occluded area and a first open area. The second projection 88 has been effectively rotated such that the occluded area of the second projection blocks the open area of the first projection 86. The third projection 90 blocks the open are of the second projection 88. Similarly, the fourth projection 92 blocks the open area of the third projection 90.

Figure 6:
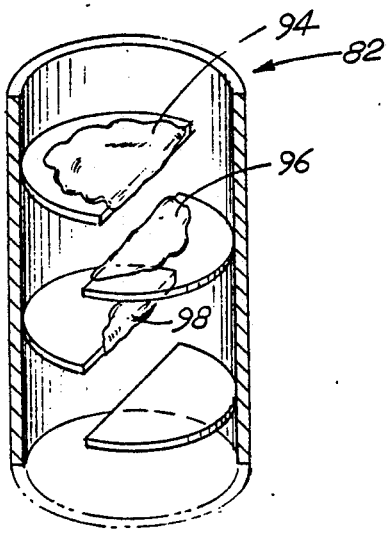
FIG. 6 is a perspective, partial cross-sectional view of the preferred embodiment shown in FIG. 5, showing a buildup of ear wax after the barrier has been in use within a hearing aid.

As shown in FIG. 6, such an arrangement of 180° circle portion projections 86–92 prevents wax from flowing directly through the housing 84. A substantial buildup of wax 94 may be anticipated on the first projection over the life of the hearing aid 22. The second projection 88 may be expected to receive a lesser amount of wax buildup 96, since it is positioned slightly deeper into the housing 84. The third projection 90, however, experiences substantially smaller amounts of wax buildup 98, since the path for wax migration has been blocked by the first and second projections 86, 88. The fourth projection 92 receives even less wax buildup, because of the wax already blocked by the first three projections 86–90.

Figure 7:
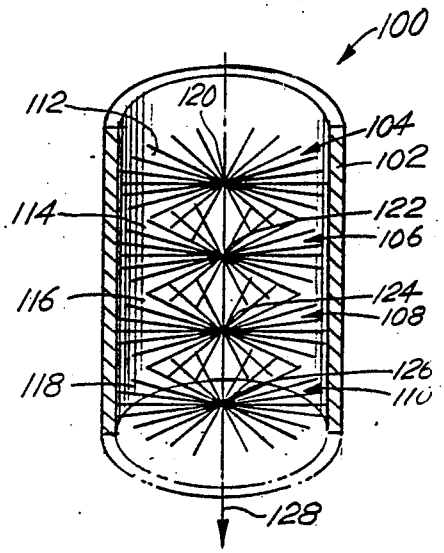
FIG. 7 is a perspective, partial cross-sectional view of a second, alternative embodiment of the barrier shown in FIG. 4.

Yet another embodiment of the present invention is shown in FIG. 7. The barrier 100 again includes a housing 102 and a multiplicity of projections 104, 106, 108, 110. The housing is substantially similar to that shown in FIGS. 4–6.

Each of the four projections 104–110 is comprised of a series of 24 spokes 112, 114, 116, 118, radiating from central points 120, 122, 124, 126 defined by the central axis 128. Each spoke is approximately 0.01 inch in diameter. In the preferred embodiment, of course, the projections 104–110 are again made of plastic, and the second projection 106 is effectively rotated a few degrees from the position of the first projection 104. In turn, the third projection 108 has been rotated slightly from the position of the second projection 106, and the fourth projection 110 has a position rotated slightly from the position of the third projection 108.

Figure 8:
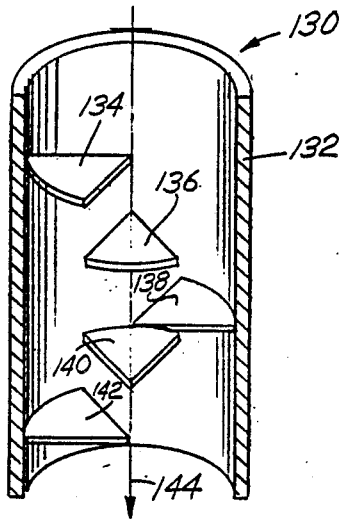
FIG. 8 is a perspective, partial cross-sectional view of a third, alternative embodiment of the barrier shown in FIG. 4.

Yet another alternative embodiment is shown in FIG. 8. In this embodiment, the barrier 130 includes a housing 132 and first, second, third, fourth, and fifth projections, 134, 136, 138, 140, 142. Each of the projections 134–142 comprises approximately a portion of a circle portion. The second projection 136 has been rotated from that of the first projection 134. The third, fourth and fifth projections 138–142 are similarly rotated from the position of each other previous projections. When the housing is viewed from the direction of the arrow of the axis 144 shown in FIG. 9, the entire internal cross-sectional area of the housing is again blocked by the projections 134–142.

The plurality of projections 134–142 have approximately the same thickness and displacement along the axis 144 as the projections previously described for the embodiments shown in FIGS. 4–7. There are five, rather than four, projections however. Thus, the housing 132 is approximately 0.02 inch longer than the housing 54 shown in FIG. 4.

Figure 9:
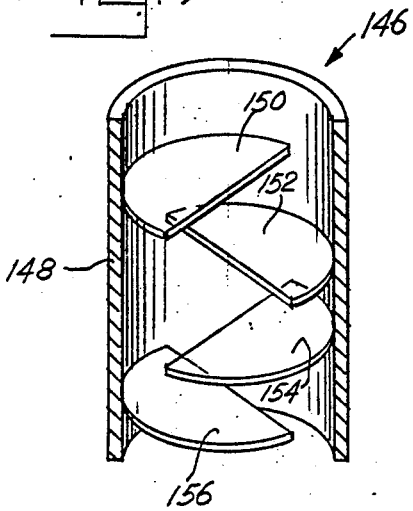
FIG. 9 is a perspective, partial cross-sectional view of a fourth, alternative embodiment of the barrier shown in FIG. 4.

Yet another alternative embodiment is shown in FIG. 9. Like the embodiment shown in FIG. 5, the barrier 146 in FIG. 9 includes a housing 148 and a plurality of projections 150, 152, 154, 156, and each of the projections 150–156 are approximately 180° circle portions However, each projection is rotated approximately 90° (rather than 180°) from the preceding projection. Thus, the second projection 152 has been rotated approximately 90° from the position of the first projection 150. The third and fourth projections 154, 156 are also rotated approximately 90°.

Figure 10:
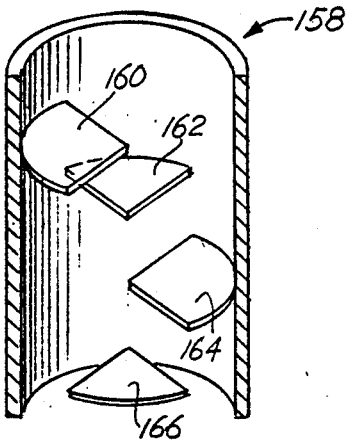
FIG. 10 is a perspective, partial cross-sectional view of a fifth, alternative embodiment of the barrier shown in FIG. 4.

A further preferred embodiment is shown in FIG. 10. Each of the projections 160–166 comprises approximately a 90° circle portion. The second projection 162 has been rotated approximately 90° from the position of the first projection 160. Similarly, the third projection 164 is rotated approximately 90° from the position of the second projection 162. The fourth projection 166 has a position which is rotated approximately 90° from the position of the third projection 164.

Figure 13:
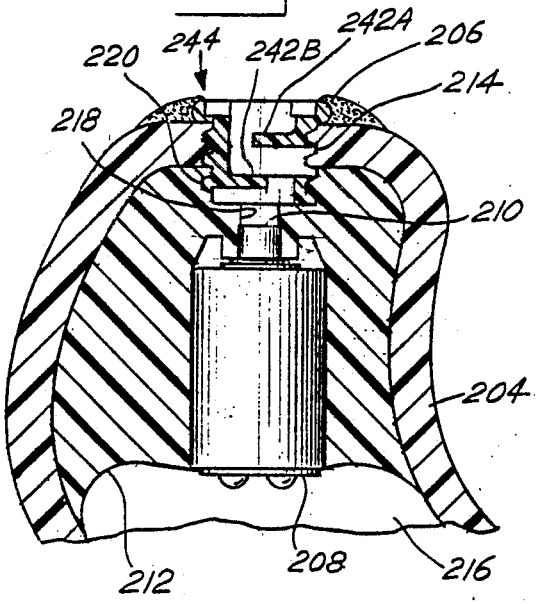
FIG. 13 is a partial cross-sectional, partial side view of a hearing aid illustrating the barrier of FIG. 11 incorporated therein.

A sixth preferred embodiment of the present invention is shown in FIGS. 11–15 as a barrier 200 for a hearing aid 202. As best shown in FIG. 13, the hearing aid 202 includes a shell 204 adapted to be inserted in an ear channel (not shown) and defining an acoustical outlet port 206. The hearing aid 202 further includes a receiver 208 having a receiver outlet port 210.

In this preferred embodiment, the receiver 208 is secured within the shell 204 by an elastomeric filling 212. That is, the receiver 208 is positionally set with respect to the shell 204 and then embedded in the filling 212. Once the filling 212 cures, the receiver 208 is secured as well as protected by the pliable, shock-absorbing filler 212.

The shell 204 includes an internally threaded opening 214 which interconnects the acoustical outlet port 206 with the interior chamber 216 of the shell 204. This opening 214 is adapted to receive the barrier 200. As best shown in FIG. 13, the shell 204 is filled in such a manner that the elastomeric filler 212 defines a substantially cylindrical channel 218 immediately adjacent the receiver outlet port 210 and an internally-threaded cavity 220 immediately adjacent and extending the opening 214 into the interior chamber 216. One advantageous feature of the filler 212 is to seal the opening 220 from the chamber 216 to avoid acoustic feedback to the microphone 42.

In this preferred embodiment, the barrier 200 is an integral piece of molded thermoplastic material, such as ABS. The barrier 200 includes a substantially cylindrical housing 222 defining a central acoustical passageway 224 between a barrier inlet port 226 and a barrier outlet port 228. The housing 222 has an externally-threaded portion 230 and a collar portion 232, which defines the outlet port 228. As shown, the outer diameter of the collar portion 232 is slightly greater than the outer diameter of the externally-threaded portion 230.

The housing 222 is adapted to be received by the internally-threaded opening 214 of the shell 204, as extended by the filler 212. Secured therein, the central axis 234 of the housing 222, or more particularly the central acoustical passageway 224, substantially aligns with the receiver outlet port 210. The barrier inlet port 226 aligns with and slightly overlays the channel 218, such that audio signals produced by the receiver 208 are received by the barrier 200 and pass through the acoustical passageway 224. That is, the passageway acoustically links to receiver 208 to the outlet 206 of the hearing aid 202.

In this preferred embodiment, the collar portion 232 of the housing 222 includes diametrically opposed slots 236A, 236B, extending from the substantially cylindrical barrier outlet port 228. These slots 236A, 236B cooperate to define key means, generally designated 238, for rotating the barrier 200 with an instrument having a screwdriver-like configuration (not shown). Utilizing the key means 238, the barrier 200 can be readily removed from the shell 204 for cleaning or replacement.

Figure 11:
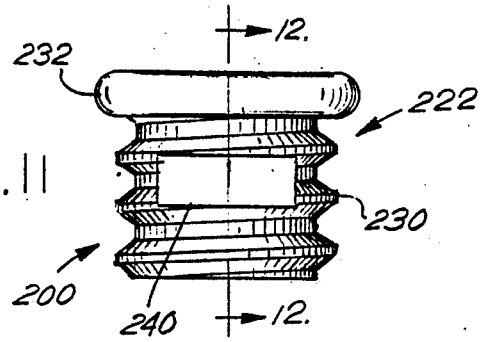
FIG. 11 is a side view of a sixth, alternative embodiment of the present invention.
Figure 12:
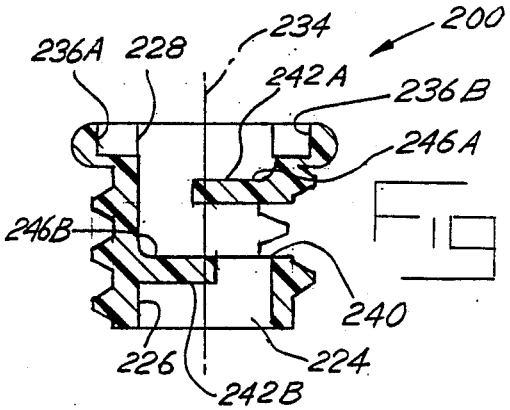
FIG. 12 is a cross-sectional view of the barrier shown in FIG. 11 taken along line 12—12.

The barrier 200 or more particularly the externally-threaded portion 230 of the housing 222 includes an access opening 240. As best shown in FIGS. 11 and 12, the access opening 240 is substantially rectangular and substantially centrally located in the externally-threaded portion 230. The access opening 240 provides direct access to the passageway 224 for inspection and cleaning.

Figure 14:
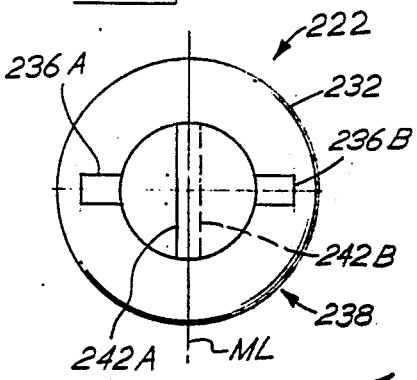
FIG. 14 is a top view of the barrier of FIG. 11.

Referring now to FIGS. 12 and 14, the barrier 200 also includes at least two substantially semi-circular projections 242A, 242B, which extend into the passageway 224. The projections 242A, 242B are equally spaced from each other and from the barrier inlet port 226 and outlet port 228 and are substantially perpendicular to the central axis 234 and the interior wall surface of the housing 222. In this preferred embodiment, the projections 242A, 242B extend slightly beyond the midline "ML" of the collar portion 232 (as shown best in FIG. 14), such that the projections 242A, 242B slightly overlap.

The projections 242A, 242B (here and in the other preferred embodiments) interrupt the central acoustical passageway 224 such that the migration of ear wax is retarded. The projections 242A, 242B cooperate to define trap means, generally designated 244, for accumulating ear wax in predetermined accumulation sites 246A, 246B, thereby retarding flow through the central acoustical passage 224 without substantial interference with the performance characteristics of the hearing aid 202. As best shown in FIG. 14, the accumulation sites 246A, 246B, in cooperation, extend completely about the interior wall surface of the housing 222.

Figure 15:
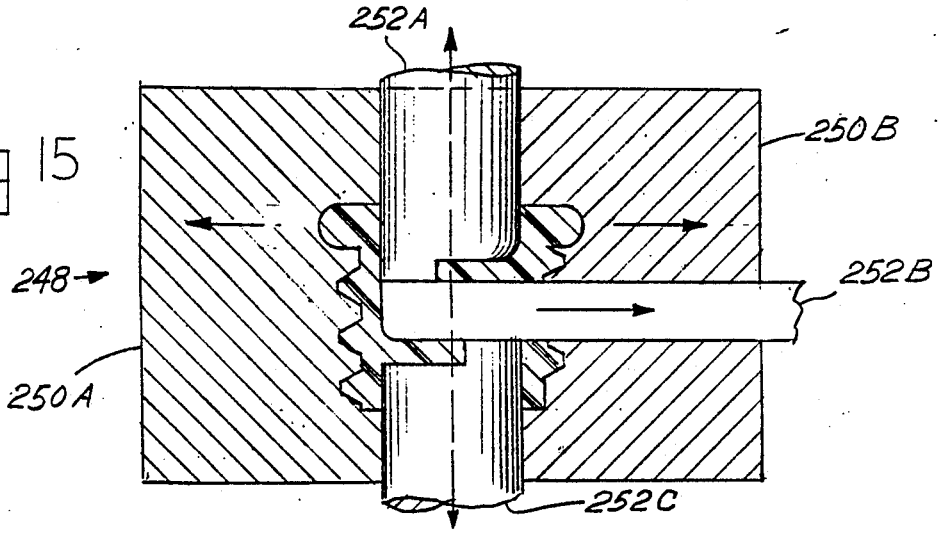
FIG. 15 is a partial cross-sectional, partial side view of a mold to produce the barrier of FIG. 11.

The barrier 200 is molded in a five-part mold 248 shown in FIG. 15. The mold 248 includes mold halves 250A, 250B adapted to receive first, second and third inserts 252A, 252B, 252C. As shown, the three inserts 252A, 252B, 252C cooperate to define the central acoustical passageway 224 and access opening 240.

Figure 16:
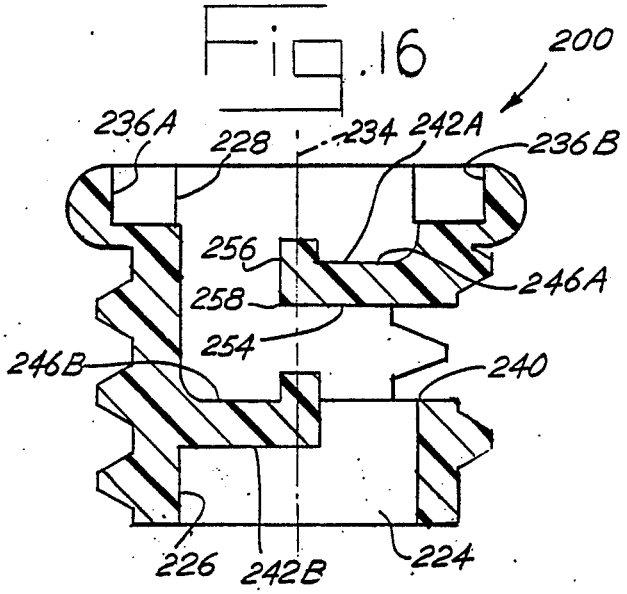
FIG. 16 is the cross-sectional view of FIG. 11 illustrating a modified projection for the barrier.
Figure 17:
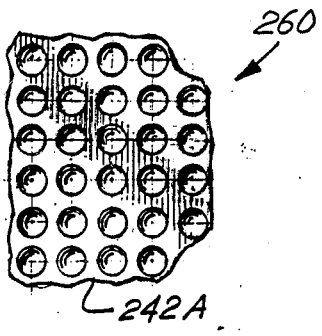
FIG. 17 is a partial top view of the modified projection shown in FIG. 16.

Referring now to FIGS. 16 and 17, a modified configuration for the projections 242A, 242B is shown. (Only one projection 242A is discussed herein for simplicity.) The projection 242A includes a disk portion 254 and a flange portion 256. The disk portion 254 is identical to the projection 242A described above and shown in FIGS. 12–15 The disk portion 254 defines a terminus edge 258.

The flange portion 256 extends from the terminus edge 258, substantially perpendicular to the disk portion 254. The flange portion 256 extends away from the receiver 208 and towards the acoustical outlet port 206 of the shell 204. The flange portion 256 creates further impedance to the migration of wax through the barrier 200 and cooperates with the disk portion 254 to define the trap means 244.

The disk portion 254 includes a series of depressions or "dimples", generally designated 260, which further retard wax migration by providing additional accumulation sites. In essence, migration is retarded since the depressions 260 must be at least partially filled before further advancement occurs.

The projection 242A shown in FIG. 16 offers an additional advantage. The configuration of the disk portion 254 and flange portion 256 provides an adjustable acoustic damping means and may, with proper dimensioning, provide substantially optimum damping of the overall frequency response, in combination with the barrier 200. In one embodiment, the flange portion 256 is connected to the disk portion 254 by a "living hinge". The orientation of the flange portion 256 is adjusted to provide a variably constricted acoustic pathway, thus providing the desired acoustic damping in combination with the barrier 200. Once properly positioned, the flange portion 256 is secured to the interior wall surface of the housing 222 by gluing or other means.

A variety of methods may be utilized to secure acoustic attenuations of the hearing aid receiver. For example, a simple plug may be inserted over the output port of the hearing aid. Also, a centered plug may be positioned in the sound pathway, to provide resistance to sound pressure. While such means do add acoustic resistance to the receiver output, modification of the acoustic resistance is difficult or impossible after the plug has been placed in the hearing aid during its manufacture. The present invention provides an adjustable acoustic impedance by means of an adjustable baffle.

Figure 18A:
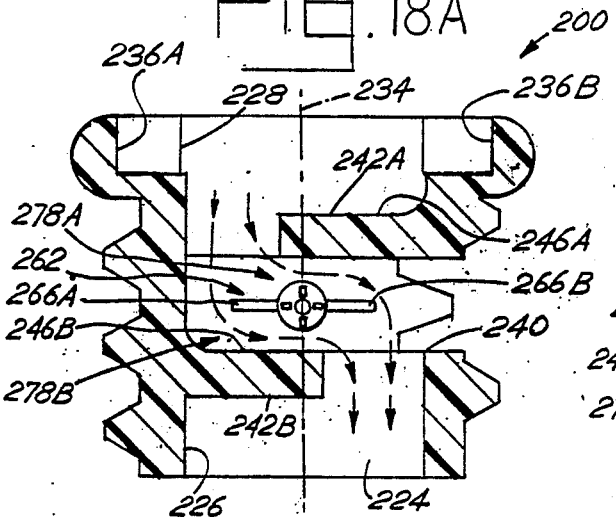
FIGS. 18*a* and 18*b* are cross-sectional views of FIG. 11 illustrating the incorporation of an acoustical baffle in an ear wax barrier.
Figure 18B:
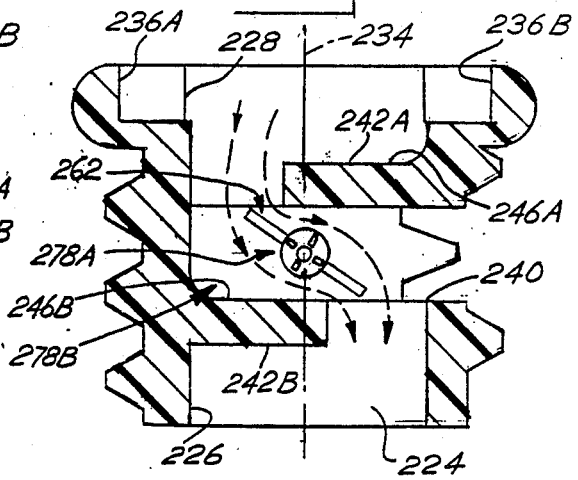
Figure 19:
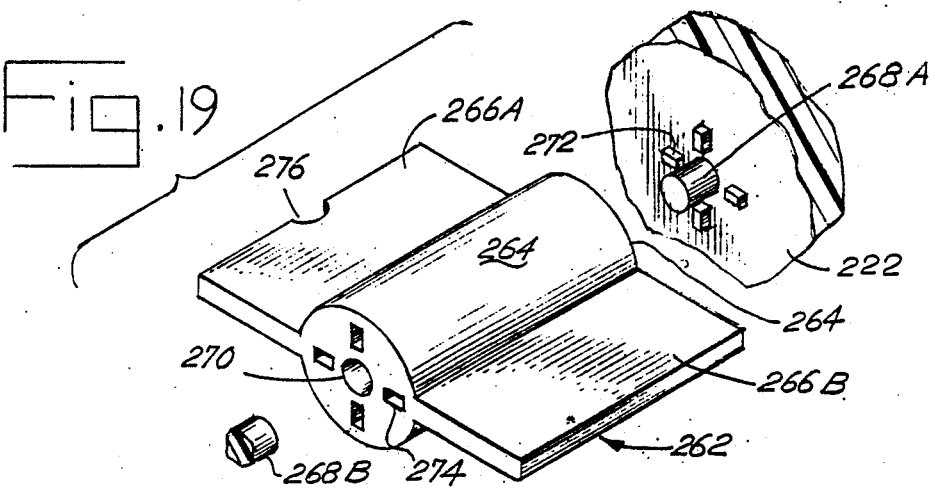
FIG. 19 is an enlarged, partial and exploded perspective view of the housing and acoustical baffle shown in FIG. 18.

As shown in FIGS. 18 and 19, the barrier 200 may include an adjustable acoustical baffle 262. The adjustable baffle 262, or "variable acoustic attenuator," includes a central, substantially cylindrical section 264 and a pair of wing sections 266A, 266B, which extend in opposed relationship from the central section 264. Each of the wing sections 266A, 266B is substantially rectangular and thin. The adjustable baffle 262 is mounted on opposed pins 268A, 268B which extend from the interior wall surface of the housing 222 and engage the channel 270 defined by the central section 264. The orientation of the adjustable baffle 262 may be set by gluing or by mated, interlocking tabs 272 on the interior wall surface of the housing 222, equally spaced about the pins 268A, 268B, and slots 274 equally spaced about the ends of the central section 264 of the adjustable baffle 262.

The adjustable baffle 262 includes an adjustment aperture 276, centrally located along one side of one of the wing sections 266A, 266B. The open areas 278A, 278B between the adjustable baffle 262 and the projections 242A, 242B provide a variably constricted passageway for damping of the overall acoustic response. The passageways 278A and 278B are substantially rectangular in shape. Each passageway 278A and 278B is defined by the edges 261A and 261B of the wings 266A and 266B, the adjacent surface of the flanges 242A and 242B, and the interior wall surface of the housing 222, respectively. The substantially rectangular passageways 278A and 278B have varying widths depending on the angular positions of the wing sections 266A and 266B of the adjustable baffle 262.

In each of the embodiments described immediately above, a tortuous path is provided to effectively reduce wax migration. Moreover, in some instances, the embodiment also includes a means for adjusting the overall acoustic damping in combination with the barrier 200. Nonetheless, substantial open areas are provided to reduce acoustic impedance by the barrier. In each of the preferred embodiments, the cross-sectional area of the housing is substantially blocked off by one or more projections.

In the preferred embodiments previously described, the barrier 20 is placed in the sound channel 50 or otherwise positioned between the output port 46 of the hearing aid shell 40 and the output port 48 of the receiver 44. Such positioning allows the barrier 20 to block wax from entering the receiver 44 from the outside of the hearing aid 22. Of course, it is understood that, as an alternative embodiment, the barrier 20 may be interconnected directly to or into the output port 48 of the receiver 44.

Referring now to FIGS. 20, 21, and 22, another modified configuration for the projections 242A and 242B is shown. The barrier 200 includes a rib 300 extending perpendicular from the disk portion 254 near the terminus edge 258 of the projection 242A to projection 242B, as shown in FIGS. 20 and **20*a*. An edge 306** provides additional area for wax accumulation.

FIG. 21 shows a configuration having plural ribs 302, 303, and 304 extending between the disk portion 254 near the terminus edge 258 of projection 242A and projection 242B. The rib portion 300 in FIGS. 20 and **20*a*, and the rib portions 302, 303, and 304 in FIG. 21, create further impedance to the migration of wax through the barrier 200** by providing additional accumulation sites.

Referring now to FIGS. 25, 26, and 27, a still further modified configuration for the projections 242A and 242B is shown. The projections 242A and 242B include extensions 308 and 310, and teeth 312 and 314, respectively.

The extensions 308 and 310 extend perpendicular to central axis 234 and provide an additional barrier to wax entering barrier 200. The teeth 312 extend from disk portion 254, parallel to the central axis 234 and perpendicular to the disk portion 254, midway between the projections 242A and 242B. The teeth 314 extend from the disk portion 318, parallel to the central axis 234 and perpendicular to the disk portion 318, midway between the projections 242A and 242B. The teeth 314 are adjacent to the edge portion 316 of the projection 242B and are interdigitated with the teeth 312 as shown in FIG. 27. The interdigitated rib portions 312 and 314 create further impedance to the migration of wax through the barrier 200 by providing still further accumulation sites.

The ribs 300, 302, 303, 304, and rib teeth 312 and 314 also provide an adjustable acoustic damping means and may, with proper dimensioning and positioning, provide substantially optimum damping of the overall frequency response, in combination with the rest of the barrier 200. Once properly dimensioned and positioned, the ribs 300, 302, 303, 304, and interdigitated teeth 312 and 314 may be secured to the projections 242A and 242B by gluing or other adhesive means or, preferably, may be molded as a part of the projections 242A and 242B during the manufacturing process.

Referring now to FIGS. 22, 23, and 24, an additional barrier in the form of a screen coupled to barrier 200 is shown. FIG. 22 illustrates a screen 320 coupled with the previously described portion of the barrier 200. The screen 320 further impedes the flow of wax that is not fully stopped by the rest of the barrier 200.

As discussed previously, the screen 320 is positioned inside the shell 204 between the filler 212 and barrier 200 to provide a barrier between barrier 200 and cylindrical channel 218. The screen 320 may be coupled to the barrier 200 by glue or other adhesive means. Alternatively, the screen 320 may be held into position simply by friction after it is snugly fit into the barrier 200.

The screen 320 also provides an adjustable acoustic damping means and may, with proper screen mesh density, provide substantially optimum acoustic damping of the overall frequency response in combination with the rest of the barrier 200. The frequency response may be tailored to accurately match the requirements of the hearing impaired user by simply and quickly replacing the screen 320 with another screen of a different screen mesh density.

The screen 320 includes a rim 322 and a screen mesh 324. Typical specifications for the screen 320 may include a stainless steel wire screen with a mesh count of approximately 165, a nominal wire diameter of 0.002 inch, a mesh opening of 0.0041 inch, and a 45% open area. Alternatively, the screen 320 may include a wire screen with a mesh count of approximately 200, a nominal wire diameter of 0.0021 inch, a mesh opening of 0.0029 inch, and a 34% open area. Values of mesh count, wire diameter, mesh opening size and open area are typically between the values specified above for proper acoustic damping and effective wax flow stoppage.

As shown in FIGS. 22, 23, 24, and 28–31, the screen 320 provides a second line of defense against ear wax migration. The screen acts as a further wax catcher for wax particles that may pass through the barrier. A large mesh screen protects the receiver and interior of the hearing aid from major wax particles. A fine screen, of course, provides protection against smaller particles.

Figure 28:
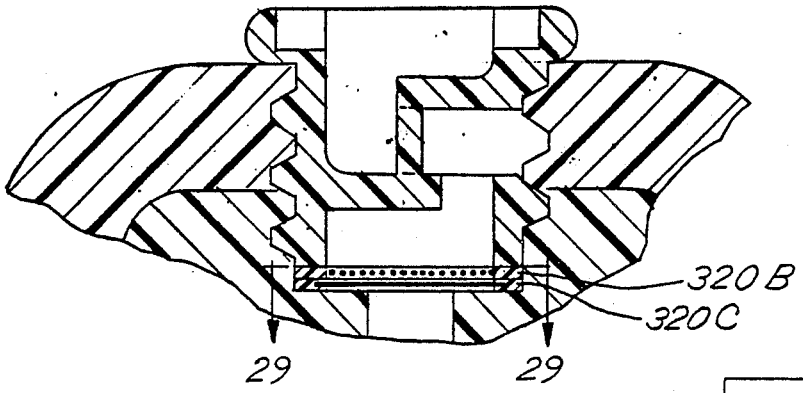
FIG. 28 is a cross-sectional view of the barrier shown in FIG. 11 illustrating the use of two separate screens.
Figure 30:
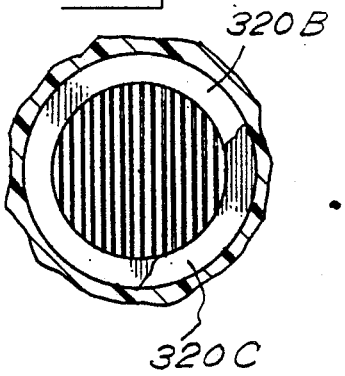
FIG. 30 is a top, partially cut away view of the two screens shown in FIG. 28 with the two screens in a parallel relationship.
Figure 29:
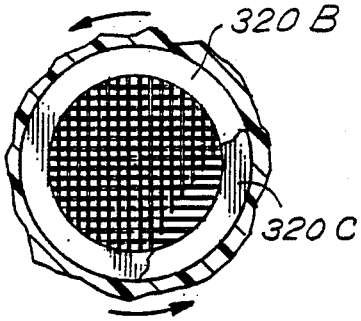
FIG. 29 is a top, partially cut away view of the two screens along the line 29—29 shown in FIG. 28 with the two screens in a orthogonal relationship and further illustrating how the screens may be rotated relative to each other to vary the acoustic impedance of the screens.

In an alternative embodiment of the present invention, a screen **320*b* may be positioned in series with an additional screen 320*c* as shown in FIG. 28. The screen density, resistance to wax flow, and acoustic impedance may thus be adjusted by simply rotating one screen relative to the other to change the screen alignment. See, for example, FIGS. 29–30 showing two screens with parallel strands. FIG. 30 discloses a top plan view of the two screens 320B and 320C; the strands of both screens are in a parallel relation to one another. FIG. 29 shows the same two screens 320B, 320C wherein one of the screens is rotated approximately 90 degrees, such that the parallel strands of the two screens are in an orthogonal relationship to one another. Thus, by rotating the screens 320B, 320C with respect to each other, one may effectively provide a variable aperture in the opening between the receiver 44 and the outside of the hearing aid acoustic output port 46**.

Figure 31:
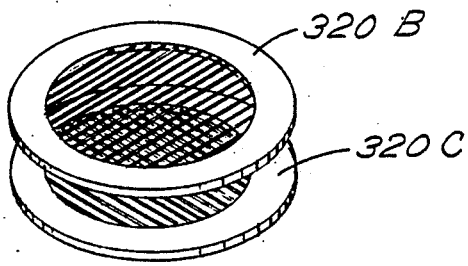
FIG. 31 is a perspective view of the two screens shown in FIG. 28.

FIG. 31 shows a perspective view of the two screens 320B, 320C, where one of them has been rotated so that the the parallel strands of the two screens are in an orthogonal relationship to one another. With the relationship shown in FIG. 30, for example, less acoustical impedance is provided to the sound waves emanating from the receiver. As two screens are rotated relative to one another, however, the acoustical impedance provided by the screens increases such that, for example, a maximum impedance is provided with the screens 320B, 320C arranged into the relative positions shown in FIGS. 29 and 31.

Thus, the size of the slots or areas between the screens vary to provide a variable acoustic impedance to the flow of sound. The porosity of the barrier; and thus the acoustic impedance of the barrier 20 may easily be varied by simply rotating one of the screens. By rotating the screens, the peaks of the frequency response of the receiver in the hearing aid are modified.

Of course, as discussed above, varying the width of the wire will also vary the possible impedances provided by the screens. Furthermore, the the distance between the wire strands, that is the screen density, may be varied to provide a multiple layer of defense against wax migration. If, for example, the upper screen 320B has a greater area between strands, it will block the flow of larger, major wax particles. The lower screen 320C may then have a smaller area between the strands, to block the flow of smaller, minor particles of wax. In this way, each screen provides a resistance to different size particles of wax, and the overall susceptibility of the screens to clogging because the wax is reduced.

The screens 320, 320B and 320C may be color-coded to reflect different screen densities, or alternatively, the barrier 200 may be color coded to reflect a different screen density in the event that the screen 320 is coupled to barrier 200 by glue or other means.

Thus, the acoustic impedance of a hearing aid may be changed by rotating screens within the barrier 20 relative to one another, replacing the barrier 20 with another barrier that has a screen or screens with different screen densities, replacing the screens within the barrier with screens that have different screen densities, or replacing the barrier 20 with another in which the screens are aligned in a different manner. Either the screen rims of replaceable screens or the replaceable barriers themselves may be color-coded to reflect the acoustic impedance inherent to that particular screen or barrier.

Figure 32:
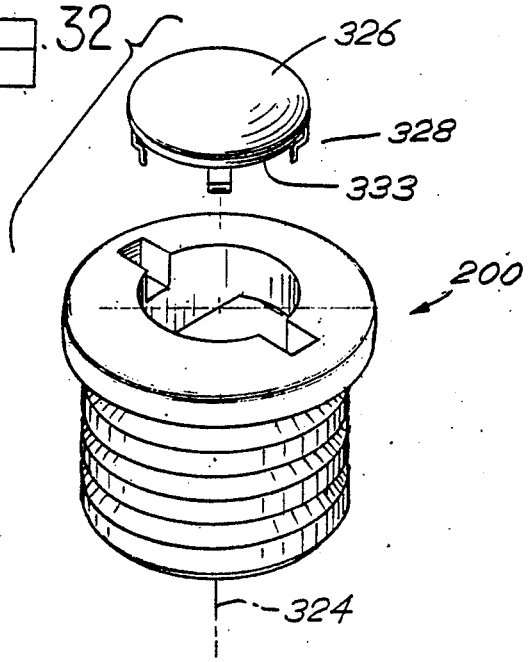
FIG. 32 is an exploded, perspective view of yet another modification of the barrier of the present invention.
Figure 33:
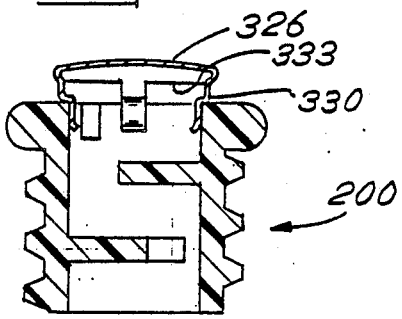
FIG. 33 is a cross-sectional view of the modification illustrated in FIG. 32.

Referring now to FIGS. 32 and 33, additional means for impeding the flow of wax into the barrier 200 are shown. FIG. 32 illustrates a substantially solid cap 326 having flanges 328 for attaching the cap 326 to the barrier 200. The flanges 328 provide a spring force extending radially outward from the central axis 324 to secure cap 326 to barrier 200.

FIG. 33 shows the cap 326 and flanges 328 attached to the barrier 200. The flanges 328 include a substantially 90 degree bend 330 that suspends the cap 326 a fraction of an inch above the barrier 200. Since the cap 326 extends above the rest of the barrier 200 (typically between 0.05 and 0.25 inch), only a limited path exists for wax to enter the hearing aid receiver 44, and acoustic energy from the receiver 44 may pass between a lower portion 332 of cap 326 and the inlet of barrier 200.

The cap 326 is removably coupled to barrier 200 by flanges 328 to facilitate cleaning and or removal of barrier 200 from shell 204. The cap 326 may be fabricated of a plastic or metal material.

Figure 34:
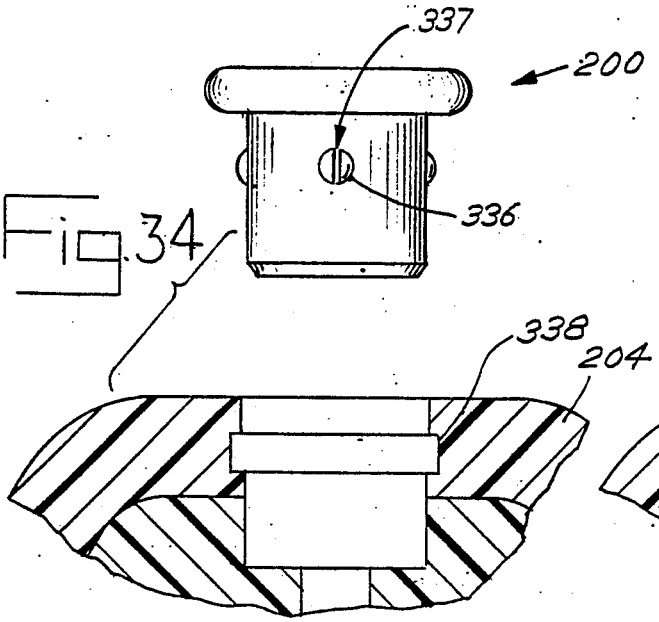
FIG. 34 is an exploded side view of still another alternative embodiment of the present invention.
Figure 35:
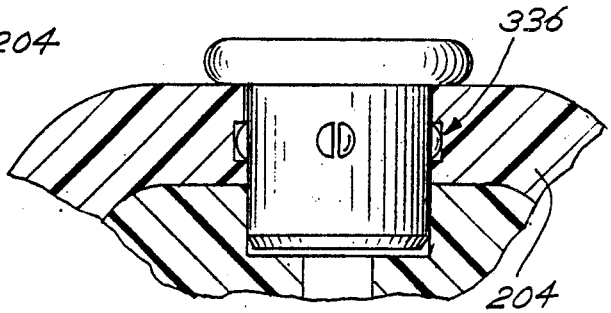
FIG. 35 is a side view of the embodiment shown in FIG. 34 illustrating the barrier inserted in the shell.

Referring now to FIGS. 34 and 35, an alternative means for coupling barrier 200 to shell 204 is shown. In the alternative embodiment, the barrier 200 includes a plurality of substantially equally spaced, dome-shaped flanges 336 on the housing 222. A channel 337 extends through each illustratively designated flange 336. The domed-shaped flanges 336 are received in a detent 338 formed in shell 204 so that collar portion 232 rests on shell 204.

The barrier 200 is removably inserted in shell 204 by applying a force to collar 232. The channel 337 of the dome-shaped flanges 336 allow the flanges 336 to deform under pressure so that barrier 200 may be received by shell 204.

By way of background, referring now to FIGS. 36–42, a barrier driver 340 is shown for expediently interchanging the barrier 200. By using the barrier driver 340, the barrier 200 may be easily removed and cleaned, or replaced with a new barrier, when ear wax degrades the performance of the hearing aid 22.

The barrier driver 340 includes a handle 342, barrier driver end 344, and a barrier remover end 346. The handle 342 includes longitudinal striations 348 to provide a non-slip grip.

Figure 36:
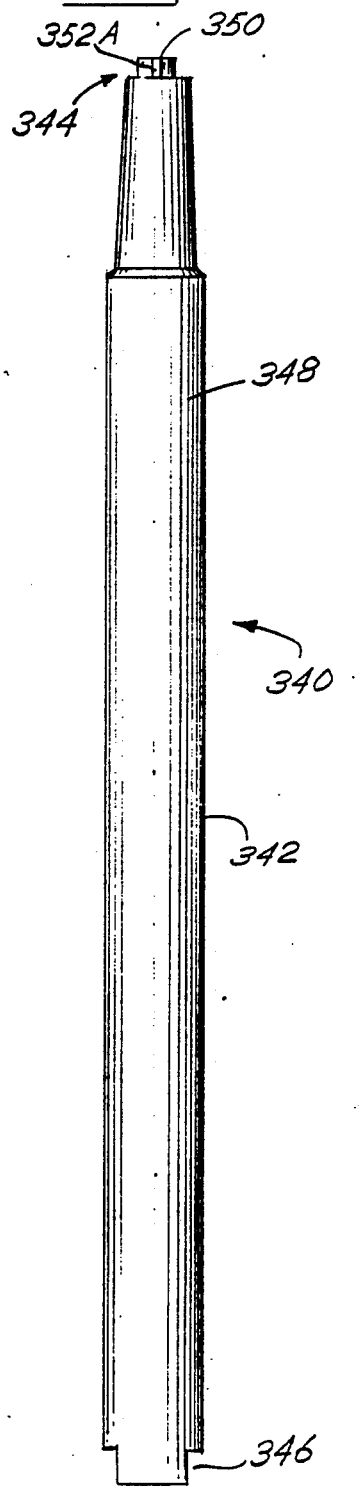
FIG. 36 is a plan view of an instrument used to insert and remove the barrier from the shell of the hearing aid.
Figure 37:
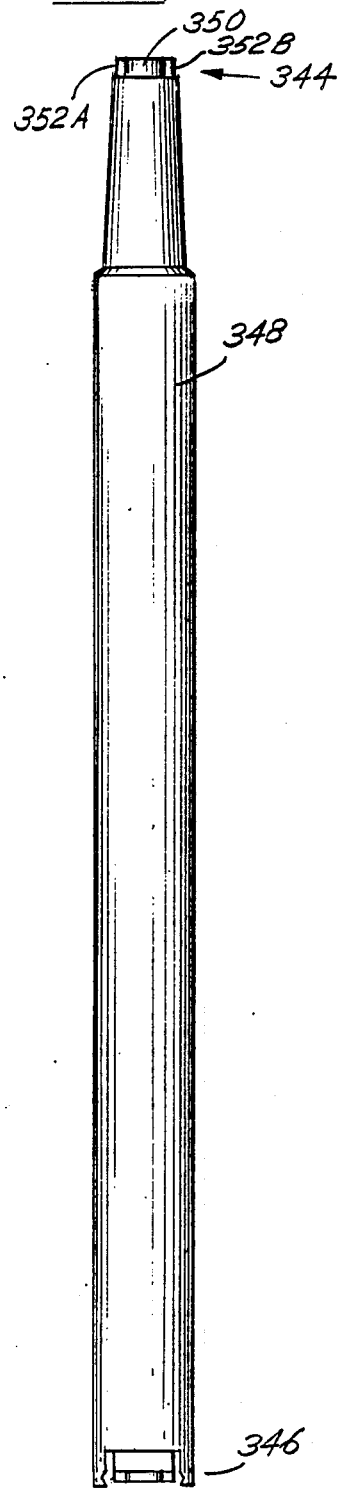
FIG. 37 is a plan view of the instrument shown in FIG. 36 rotated 90 degrees.
Figure 38:
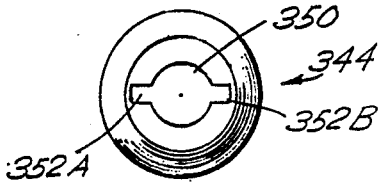
FIG. 38 is a plan view of the top end portion of the instrument shown in FIG. 37.
Figure 39:
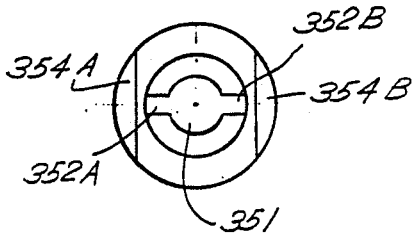
FIG. 39 is a plan view of the bottom end portion of the instrument shown in FIG. 37.
Figure 40:
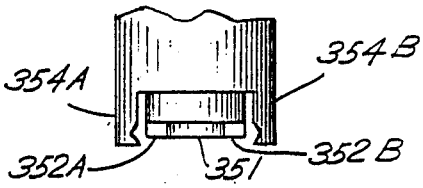
FIG. 40 is a partial plan view of the bottom end portion of the instrument shown in FIG. 37.
Figure 41:
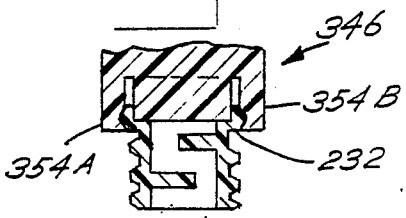
FIG. 41 is a partial cross-sectional view of the bottom end portion of the instrument shown in FIG. 37, with the instrument engaged with the barrier.
Figure 42:
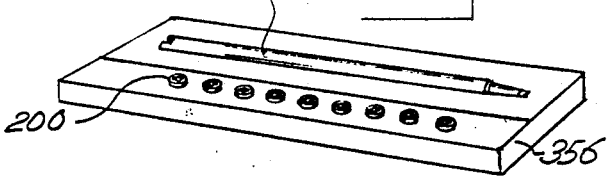
FIG. 42 is a perspective view of a set of replacement barriers and an insertion and removal instrument in a container.

Referring now to FIGS. 36–38, the barrier driver end 344 includes a cylindrical projection 350 having diametrically opposed fins 352A and 352B. The projection 350 and fins 352A and 352B matingly engage the slots 236A and 236B of barrier 200.

Referring now to FIGS. 36, 37 and 39–40, the barrier remover end 346 includes projections 354A and 354B in addition to a cylindrical projection 351, and fins 356A and 356B. The fins 356A and 356B are diametrically opposed for matingly engaging the collar 232 of barrier 200, removing one of a plurality of barriers 200 from the tray, and inserting the barrier into shell 204 of the hearing aid 22.

Various preferred embodiments of the present invention have been described herein. It is to be understood, of course, that changes and modifications may be made in the embodiments without departing from the true scope and spirit of the present invention as defined by the appended claims.

What is claimed is:

1. A barrier for a hearing aid, said hearing aid including a shell having an acoustical outlet and a receiver positioned within said shell, said receiver having a receiver outlet port and emitting sound that partially defines an acoustic response for said hearing aid, comprising, in combination:

a housing adapted to be received by said shell, said housing including a central acoustical passageway linking said acoustical outlet and said receiver outlet port, said central acoustical passageway being defined by an interior wall surface of said housing and substantially defining a central axis;

at least two projections within said central acoustical passageway, said projections being spatially and angularly displaced with respect to said central axis and cooperating to occlude a linear path through said central acoustical passageway, said two projections being substantially perpendicular to said central axis, said projections cooperatively defining trap means for providing wax accumulation sites within said housing, whereby migration of ear wax into said hearing aid is substantially retarded; and an acoustic attenuator, said acoustic attenuator and projections cooperatively defining means for damping said acoustic response of said hearing aid, said acoustic attenuator including a screen for damping said acoustic response of said hearing aid;

said screen being comprised of wire strands wherein all said wire strands are substantially parallel and arranged substantially in a single plane, said plane of said screen being substantially perpendicular to said central axis, whereby said wire strands of said screen partially occlude said central passageway and define additional trap means, providing further wax accumulation cites within said housing.

2. A barrier as claimed in claim 1 wherein said barrier is a discrete, removable component and said acoustic response of said hearing aid may be varied by removing said barrier from said hearing aid, said barrier comprising said screen with a first screen density, and replacing said barrier with a second barrier, said second barrier comprising a second screen with a second, different screen density, said damping of said frequency response of said hearing aid being dependent upon said screen density.

3. A barrier as claimed in claim 1 wherein said barrier includes first and second screens, each of said screens being comprised of a series of substantially parallel wire strands arranged substantially in a single plane, said attenuation being variable by rotating one of said screens relative to the other screen to vary the alignment of said wire strands of said first and second screens, whereby rotation of said screens varies said acoustic attenuation of said barrier.

4. A barrier for a hearing aid, said hearing aid including a shell having an acoustical outlet and a receiver positioned within said shell, said receiver having a receiver outlet port and emitting sound that partially defines an acoustic response for said hearing aid, comprising, in combination:

a housing adapted to be received by said shell, said housing including a central acoustical passageway linking said acoustical outlet and said receiver outlet port, said central acoustical passageway being defined by an interior wall surface of said housing and substantially defining a central axis;

at least two projections within said central acoustical passageway, said projections being spatially and angularly displaced with respect to said central axis and cooperating to occlude a linear path through said central acoustical passageway, said two projections being substantially perpendicular to said central axis, said projections cooperatively defining trap means for providing wax accumulation sites within said housing, said wax accumulation sites cooperatively extending completely about said interior wall surface, whereby migration of ear wax into said hearing aid is substantially retarded, said projections including interdigitated ribs extending substantially parallel to said central axis to further impede the flow of wax between adjacent projections; and a variable acoustic attenuator, said variable acoustic attenuator and said projections cooperatively defining means for damping said acoustic response of said hearing aid.

5. A barrier as claimed in claim 4 wherein each of said interdigitated ribs are displaced along each of said projections transverse to the plane of said projections.

* * * * *